US007554254B2

(12) United States Patent
Lee et al.

(10) Patent No.: US 7,554,254 B2
(45) Date of Patent: Jun. 30, 2009

(54) FLAT FLUORESCENT LAMP

(75) Inventors: Young Jong Lee, Sungnam-shi (KR); Jun Young Choi, Seoul (KR); Jun Ho Jeong, Ohsan-shi (KR); Ji-Won Kim, Seoul (KR); Young-Keun Lee, Uiwang-shi (KR); Young-Kwan Park, Gyeongsangbuk-do (KR); Jun-Ho Lee, Daegu (KR)

(73) Assignee: Advanced Display Process Engineering Co., Ltd., Seongnam-Si (KR)

( * ) Notice: Subject to any disclaimer, the term of this patent is extended or adjusted under 35 U.S.C. 154(b) by 549 days.

(21) Appl. No.: 11/135,037

(22) Filed: May 23, 2005

(65) Prior Publication Data

US 2005/0264160 A1 Dec. 1, 2005

(30) Foreign Application Priority Data

Jun. 1, 2004 (KR) ..... 10-2004-0039480
Jun. 17, 2004 (KR) ..... 10-2004-0045094

(51) Int. Cl.

*H01J 11/00* (2006.01)
*H05B 41/16* (2006.01)
*F21V 7/04* (2006.01)
*H01J 63/04* (2006.01)

(52) U.S. Cl. ..... 313/485; 313/491; 313/493; 445/26; 315/246

(58) Field of Classification Search ..... 313/484–485, 313/490, 607, 234; 445/24–25
See application file for complete search history.

(56) References Cited

U.S. PATENT DOCUMENTS

| | | | | |
|---|---|---|---|---|
| 5,220,249 | A * | 6/1993 | Tsukada | 315/246 |
| 5,850,122 | A * | 12/1998 | Winsor | 313/493 |
| 6,246,171 | B1 * | 6/2001 | Vollkommer et al. | 313/586 |
| 6,603,248 | B1 * | 8/2003 | Trentelman | 313/234 |
| 6,830,354 | B2 * | 12/2004 | Ono | 362/614 |
| 2002/0105259 | A1 * | 8/2002 | Kim | 313/491 |
| 2002/0105793 | A1 * | 8/2002 | Oda et al. | 362/31 |

FOREIGN PATENT DOCUMENTS

KR 1020020085375 A 11/2002

* cited by examiner

*Primary Examiner*—Sikha Roy
*Assistant Examiner*—Tracie Y Green
(74) *Attorney, Agent, or Firm*—Ked & Associates LLP

(57) ABSTRACT

The present invention provides a flat fluorescent lamp. The flat fluorescent lamp comprises a single plate. Consequently, the flat fluorescent lamp is structurally safe, brightness of the flat fluorescent lamp is high, and efficiency of the flat fluorescent lamp is also high without the provision of other additional optical components. The present invention also provides a method of manufacturing such a flat fluorescent lamp.

15 Claims, 9 Drawing Sheets

(prior art)

FLAT FLUORESCENT LAMP

CROSS-REFERENCE TO RELATED APPLICATIONS

The present application claims priority under The Paris Convention for the Protection of Industrial Property to Korean Application No. 10-2004-0039480 filed on Jun. 1, 2004 and to Korean Application No. 10-2004-0045094 filed on Jun. 17, 2004, both of which are incorporated herein by reference.

BACKGROUND OF THE INVENTION

1. Field of the Invention

The present invention relates to a flat fluorescent lamp, and, more particularly, to a flat fluorescent lamp comprising a main plate, whereby the structure of the flat fluorescent lamp is simplified, and the manufacture of the flat fluorescent lamp is easy. Also, the present invention relates to a method of manufacturing the same.

2. Description of the Related Art

Liquid crystal display (LCD) panels, which have been widely used in flat panel display devices, cannot emit light by themselves. As a result, backlight devices for providing a light source are attached to the liquid crystal display panels.

Backlight devices are classified into a direct-type backlight device and an edge-type backlight device. Such classification of the backlight devices is based on the position where the lamps are disposed. In the edge-type backlight device, the lamps are disposed at the edge of a transparent light guide panel such that light can be reflected and diffused through one surface of the light guide panel. As a result, a flat light source obtained through multiple reflection of light illuminates cells of the liquid crystal display panel. In the direct-type backlight device, on the other hand, the lamps are disposed directly under the cells of the liquid crystal display panel. A diffusion panel is disposed in front of the lamps, and a reflective panel is disposed at the rear of the lamps, such that light emitted from the light source can be reflected and diffused.

In the edge-type backlight device, brightness of the backlight device is moderate while uniformity of brightness is high. As a result, it is difficult to apply the edge-type backlight device to large-sized liquid crystal display panels. For this reason, the large-sized liquid crystal display panels mainly employ the direct-type backlight devices.

A conventional direct-type backlight device 1 is shown in FIG. 1.

FIG. 1 is a perspective view showing the structure of the conventional direct-type backlight device 1.

The direct-type backlight device 1 comprises a lamp unit 10, a reflective panel 20, a diffusion panel 30, and a prism sheet 40. The lamp unit 10 comprises a plurality of lamps 12, which may be either cold cathode fluorescent lamps (CCFLs) or external electrode fluorescent lamps (EEFLs). Irrespective of the fluorescent lamp used, the lamp unit 10 is constructed such that the lamps, each of which is formed in the shape of an elongated cylinder having a small diameter, are arranged in parallel with one another. When the cold cathode fluorescent lamps are used, it is necessary that inverters (not shown) be assigned to the respective lamps. When the external electrode fluorescent lamps are used, on the other hand, the lamps are driven by a single inverter. However, higher voltage must be applied to the external electrode fluorescent lamps than the cold cathode fluorescent lamps.

The reflective panel 20 is attached to the rear surface of the lamp unit 10 for reflecting light irradiated from the lamp unit 10 to the front surface of the lamp unit 10. The diffusion panel 30 and the prism sheet 40 are attached to the front surface of the lamp unit 10. The diffusion panel 30 serves to uniformly diffuse light, and the prism sheet 40 serves to guide the light diffused by the diffusion panel 30 in a straight line using a refraction phenomenon of light such that the light can be delivered to the cells of the liquid crystal display panel. A light guide panel may be attached to the front surface of the lamp unit 10 according to circumstance.

As the sizes of liquid crystal display panels are increased, the lengths of lamps used in the backlight device are also increased. For example, lamps each having a diameter of 4 mm and a length of 1000 to 1200 mm are used for 40-inch liquid crystal display televisions (LCD TVs). However, it is very difficult to manufacture the lamps with these dimensions. Furthermore, it is difficult to handle the narrow and elongated lamps when the backlight device is manufactured. The narrow and elongated lamps are very weak, and therefore, the narrow and elongated lamps may be easily damaged during handling of the narrow and elongated lamps.

The above-mentioned problems become increasingly serious as wide-screen liquid crystal display televisions are developed. For example, lamps each having a length of more than 2000 mm are required for 60-inch liquid crystal display televisions. However, it is not possible to manufacture such elongated lamps in accordance with conventional lamp manufacturing methods.

SUMMARY OF THE INVENTION

Therefore, the present invention has been made in view of the above problems, and it is an object of the present invention to provide a flat fluorescent lamp that is easily manufactured, is structurally simplified, has excellent brightness, and therefore, is very suitable for large-sized flat panel display devices.

It is another object of the present invention to provide a flat fluorescent lamp manufacturing method that is capable of easily manufacturing a flat fluorescent lamp having excellent efficiency.

It is another object of the present invention to provide a flat fluorescent lamp board manufacturing apparatus that is capable of easily manufacturing a flat fluorescent lamp board having excellent efficiency.

It is yet another object of the present invention to provide a flat fluorescent lamp board manufacturing method that is capable of easily manufacturing a flat fluorescent lamp board having excellent efficiency.

In accordance with one aspect of the present invention, the above and other objects can be accomplished by the provision of a flat fluorescent lamp for flat panel display backlighting, comprising: a main plate having at least one through-hole formed therein; electrode units attached to both sides of the main plate, each of the electrode units having at least one electrode corresponding to the at least one through-hole of the main plate, the electrode units sealing both ends of the at least one through-hole of the main plate; a fluorescent material applied to the inner circumferential surface of the at least one through-hole of the main plate; and a light-emitting gas filled in an inner space defined by the at least one through-hole of the main plate and the electrode units.

In accordance with another aspect of the present invention, there is provided a method of manufacturing a flat fluorescent lamp, comprising: a main plate manufacturing step for manufacturing a main plate to form at least one through-hole in the main plate; a fluorescent material applying step for applying a fluorescent material to the inner circumferential surface of the at least one through-hole of the main plate; a firing step for firing the main plate to a predetermined temperature; an electrode unit attaching step for attaching electrode units to both sides of the main plate; an exhausting step for removing gas from the interior of the at least one through-hole of the main plate; a light-emitting gas injecting step for injecting a light-emitting gas into the interior of the at least one through-hole of the main plate; and a sealing step for hermetically sealing the at least one through-hole of the main plate.

In accordance with another aspect of the present invention, there is provided an apparatus for manufacturing a flat fluorescent lamp board, comprising: a plurality of first board molding units, each of which has the same shape as the flat fluorescent lamp board; a second board molding unit for molding a board loaded to the corresponding first board molding unit in the shape of the flat fluorescent lamp board; and a plurality of heating units for heating the first board molding units and the board to a predetermined temperature.

In accordance with yet another aspect of the present invention, there is provided a method of manufacturing a flat fluorescent lamp board, comprising: a board loading step for loading a board to one of first board molding units; a molding step for molding the board loaded to the corresponding first board molding unit in the shape of the flat fluorescent lamp board; and a board discharging step for discharging the board from a flat fluorescent lamp board manufacturing apparatus.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
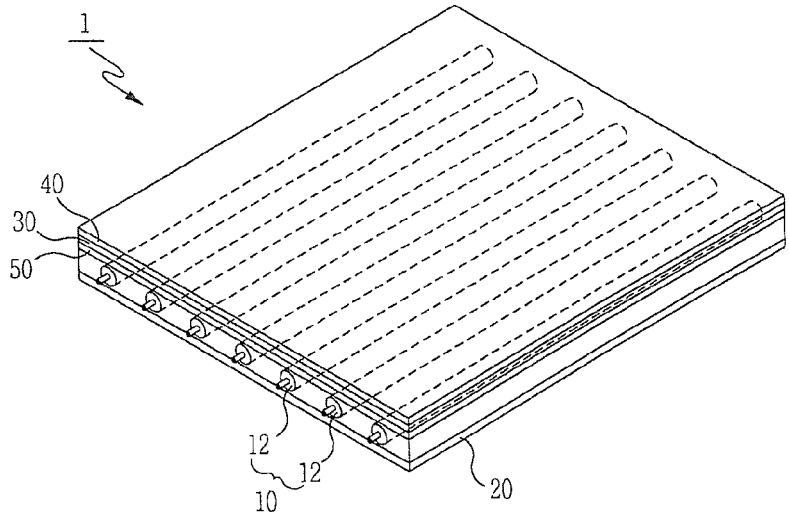
FIG. 1 is a perspective view showing the structure of a conventional direct-type backlight device.

Now, preferred embodiments of the present invention will be described in detail with reference to the accompanying drawings.

Embodiment 1

Flat Fluorescent Lamp

A flat fluorescent lamp 100 according to a first preferred embodiment of the present invention will be described below in detail.

The flat fluorescent lamp 100 comprises a main plate 110, electrode units 120, fluorescent materials 130, and electric discharge gas 140.

The main plate 110 is a main component forming the shape of the flat fluorescent lamp 100 according to the first preferred embodiment of the present invention. A plurality of through-holes 112 are formed to penetrate the main plate 110. Preferably, the number of the through-holes 112 is two or more. The through-holes 112 are extended from first side surface 110*a* of the main plate 110 to second side surface 110*b* of the main plate 110. The through-holes 112 are arranged in parallel with one another. In the first preferred embodiment of the present invention, the through-holes 112 are formed simultaneously when the main plate 110 is molded. Consequently, an additional process of forming the through-holes 112 is not necessary.

It is required that the main plate 110 be made of a visible light transmissive material, i.e., a material through which visible light is transmitted. This is because brightness of the flat fluorescent lamp is increased when visible light generated in the through-holes 112 and reflected by a reflective panel is satisfactorily transmitted through the main plate 110.

For this reason, the main plate 110 is made of glass in the first preferred embodiment of the present invention, although the main plate 110 may be made of other materials, such as acryl resin.

The main plate 110 may be provided at the upper surface thereof with an optical light guide panel pattern. The conventional flat fluorescent lamp has an additional light guide panel attached to the upper surface thereof to improve uniformity of the brightness. On the contrary, the optical light guide panel pattern corresponding to the light guide panel of the conventional flat fluorescent lamp is directly formed on the upper surface of the main plate 110 to obtain light having uniform brightness without the provision of the additional means. Consequently, the structure of the flat fluorescent lamp is simplified, and therefore, the overall thickness of the backlight device is decreased.

To the lower surface of the main plate 110 is preferably attached a reflective panel 150 for reflecting visible light. The reflective panel 150 serves to reflect some of the visible light irradiated in the through-holes 112, which is irradiated toward the lower surface of the main plate 110, such that the light irradiated toward the lower surface of the main plate 110 is irradiated toward the upper surface of the main plate 110.

Consequently, the brightness of light generated by the flat fluorescent lamp 100 is increased.

The reflective panel 150 may be formed on the lower surface of the main plate 110 not by attaching an additional member to the lower surface of the main plate 110 but by directly depositing a visible light reflective material on the lower surface of the main plate 110. In this way, the reflective panel 150 may be formed on the lower surface of the main plate 110 without the provision of the additional member. Consequently, the structure of the flat fluorescent lamp is simplified, and therefore, the thickness of the backlight device, which incorporates the flat fluorescent lamp, is decreased.

Of course, it is possible to attach an additional reflective panel for reflecting visible light to the lower surface of the flat fluorescent lamp.

Figure 3:
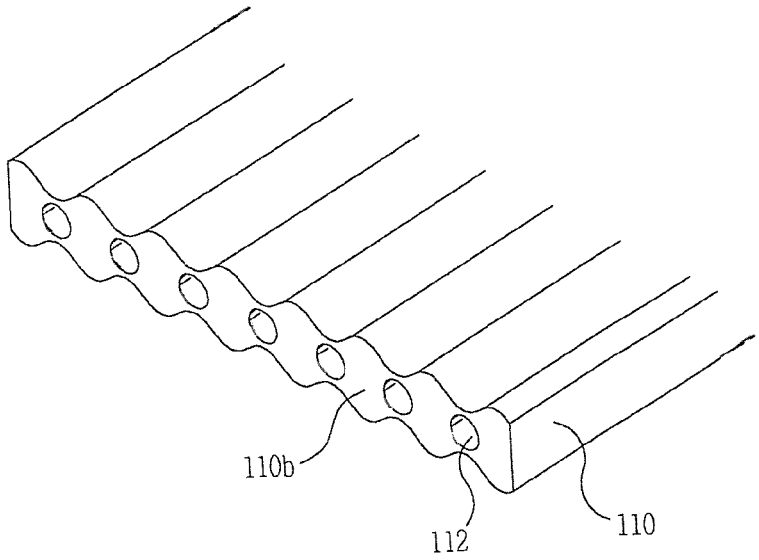
FIG. 3 is a perspective view showing another example of the main plate shown in FIG. 2.

Preferably, the upper and lower surfaces of the main plate 110 are flat. However, the upper and lower surfaces of the main plate 110 may be formed in the shape of waves, as shown in FIG. 3, in order to solve the problem in that there is the difference in brightness between the sections of the main plate 110 where the through-holes 112 are formed and the sections of the main plate 110 where the through-holes 112 are not formed. Specifically, the problem in that the brightness of the sections of the main plate 110 where the through-holes 112 are formed is greater than that of the sections of the main plate 110 where the through-holes 112 are not formed is solved using refraction. Consequently, excellent uniformity of brightness is obtainable by provision of the flat fluorescent lamp of the first preferred embodiment of the present invention.

When the upper and lower surfaces of the main plate 110 are formed in the shape of waves, the areas of the upper and lower surfaces of the main plate 110 that come into contact with air are increased. Consequently, heat generated when manufacturing the main plate 110 is easily removed from the main plate 110, and therefore, the effective cooling of the main plate 110 is accomplished.

Figure 6:
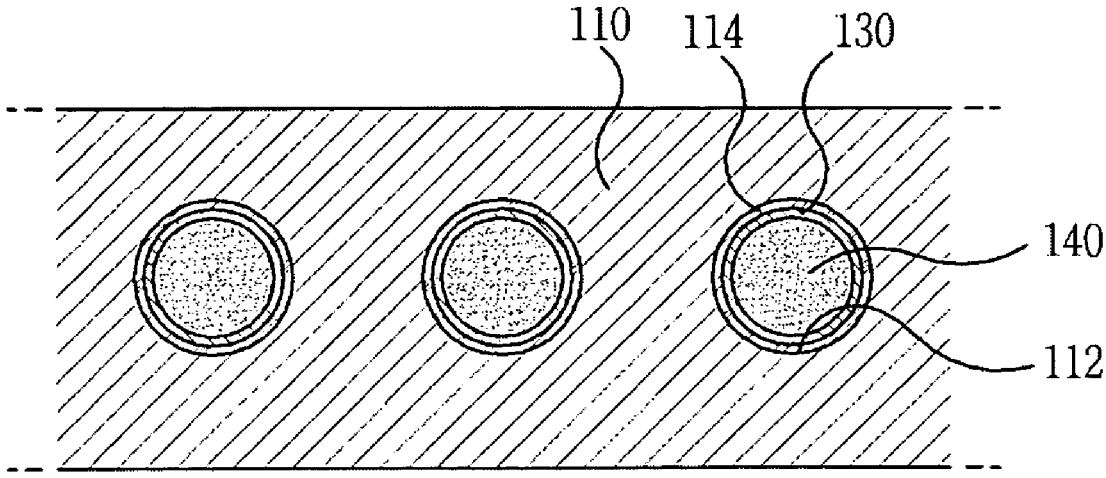
FIG. 6 is a sectional view showing the structure of through-holes of the flat fluorescent lamp according to the first preferred embodiment of the present invention.

As shown in FIG. 6, a protective film 114 is applied to the inner circumferential surface of each through-hole 112. When electricity is discharged, electrons collide with the inner circumferential surface of each through-hole 112 with the result that the inner circumferential surface of each through-hole 112 is damaged. The damage to the inner circumferential surface of each through-hole 112 is effectively prevented by the provision of the protective film 114. Also, the protective film 114 serves to securely fix the fluorescent material 130 to the inner circumferential surface of each through-hole 112.

The fluorescent material 130 is applied to the inner circumferential surface of each protective film 114. The fluorescent material 130 serves to emit visible light when electric current is supplied to the flat fluorescent lamp 100. Preferably, the fluorescent material 130 is a material selected from the group consisting of phosphate-based fluorescent material, silicate-based fluorescent material, tungstate-based fluorescent material, and sulfide-based fluorescent material.

Figure 2:
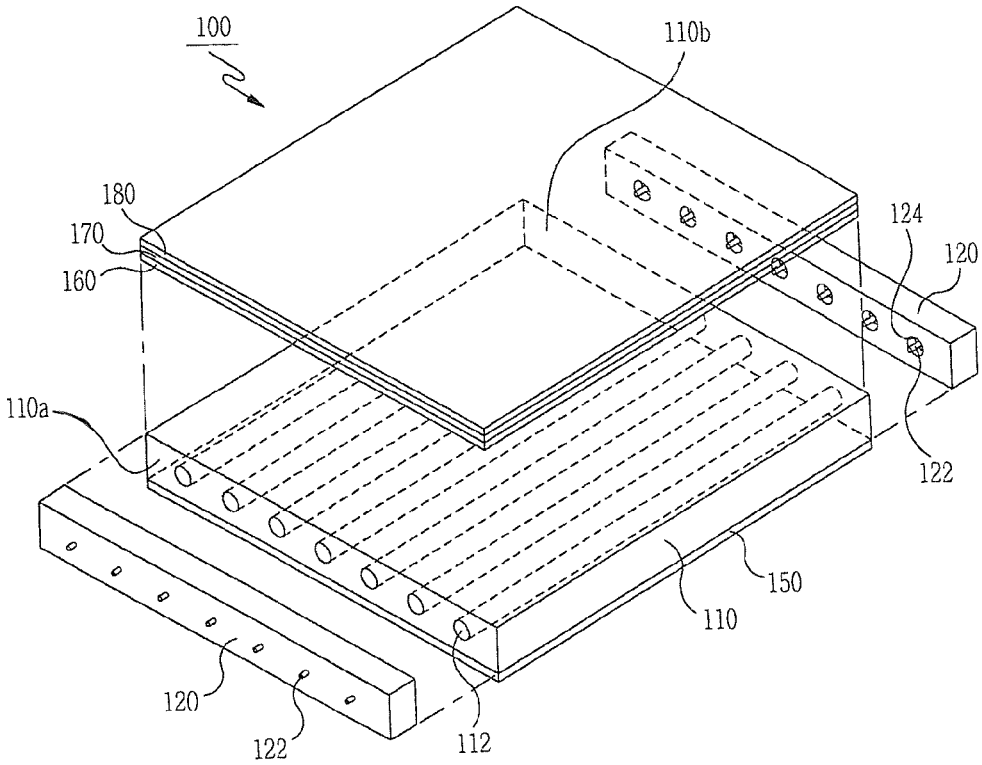
FIG. 2 is an exploded perspective view showing the structure of a flat fluorescent lamp according to a first preferred embodiment of the present invention.

As shown in FIG. 2, the electrode units 120 are attached to both sides of the main plate 110, respectively. Each electrode unit 120 has electrodes 122, which correspond to the through-holes 112 of the main plate 110. At the respective positions of each electrode unit 120 where the electrodes 122 are provided are formed depression parts 124 each having a predetermined depth. Each of the depression parts 124 may be formed in the sectional shape of a circle or a polygon.

Each of the electrodes 122 provided at each electrode unit 120 may be an internal-type or external-type electrode.

Figure 4:
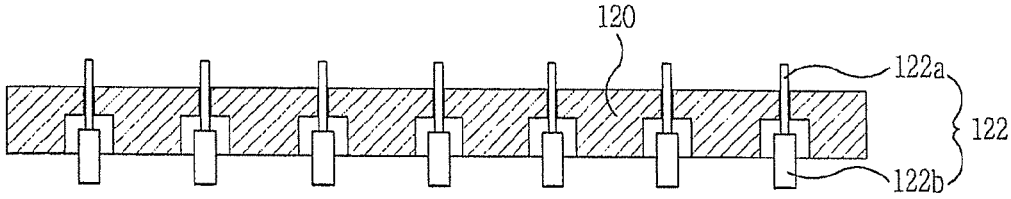
FIG. 4 is a sectional view showing the structure of an electrode unit of the flat fluorescent lamp according to the first preferred embodiment of the present invention.

The internal-type electrodes are electrodes that are disposed inside communication parts of each electrode unit 120, which communicate with the through-holes 112 of the main plate 110, respectively, such that the internal-type electrodes come into direct contact with electric discharge gas. Such internal-type electrodes are shown in FIG. 4. As shown in FIG. 4, each of the electrodes 122 has one end 122*b* protruded such that the end 122*b* is inserted into the corresponding through-hole 112 of the main plate 110 and the other end 122*a* exposed to the outside of the corresponding electrode unit 120. To the end 122*a* of each electrode 122 is connected an inverter for supplying electric current to each electrode 122.

Figure 5:
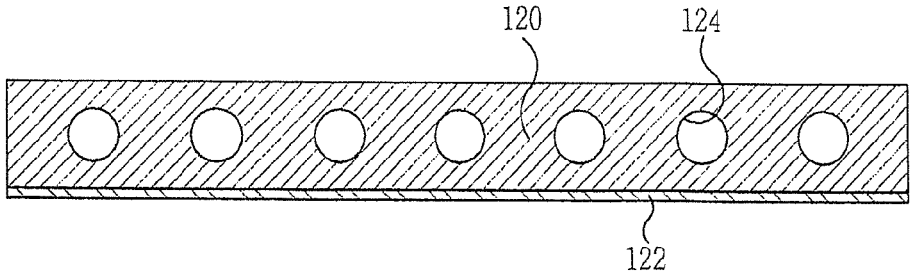
FIG. 5 is a sectional view showing the structure of another example of the electrode unit shown in FIG. 4.

The external-type electrode is an electrode that is disposed outside the communication parts of each electrode unit 120, which communicate with the through-holes 112 of the main plate 110, such that the external-type electrode does not come into direct contact with the electric discharge gas. Such external-type electrodes are shown in FIG. 5. As shown in FIG. 5, the electrode 122 is attached to the upper or lower surface of each electrode unit 120. When the external-type electrode is used as the electrode for the flat fluorescent lamp according to the first preferred embodiment of the present invention, it is necessary that the area of each electrode unit where the electrode comes into contact with each electrode unit be large to improve the efficiency of the flat fluorescent lamp. For this reason, it is preferable to form the surface of the electrode in the shape of a wave, and to form the surface of each electrode unit to which the electrode is attached in the shape corresponding to the shape of the surface of the electrode, to increase the contact area between the electrode and each electrode unit.

For the same reason, it is preferable that the section of each of the depression parts 124 formed at each electrode unit 120 be greater than that of each of the through-holes 112 of the main plate 110.

The external-type electrode is advantageous in that the electrode 122 corresponding to the respective through-holes 112 of the main plate 110 is made of a single member, and therefore, the single electrode 122 can supply electric current to all the through-holes 112 of the main plate 110 by means of a single inverter. It should be noted, however, that voltage applied to the external-type electrode must be higher that that applied to the respective internal-type electrodes.

As shown in FIG. 6, the electric discharge gas 140 is filled in the inner space defined by the through-holes 112 and the electrode units 120. Preferably, the electric discharge gas 140 consists of inert gas and mercury gas.

Argon (Ar) and neon (Ne) are mainly used as the inert gas. The argon serves to activate electrons, and the neon serves to expedite light emission. Alternatively, other inert gases, such as xenon (Xe), may be used. Each of the through-holes 112 is filled with the mercury gas, which has excellent reactivity to the electrons.

To the upper surface of the flat fluorescent lamp 100 according to the first preferred embodiment of the present invention are also attached a light guide panel 160, a diffusion panel 170, and a prism sheet 180, by which brightness of light emitted from the flat fluorescent lamp 100 is increased, and uniformity of the brightness is improved.

Embodiment 2

Flat Fluorescent Lamp Manufacturing Method

Figure 7:
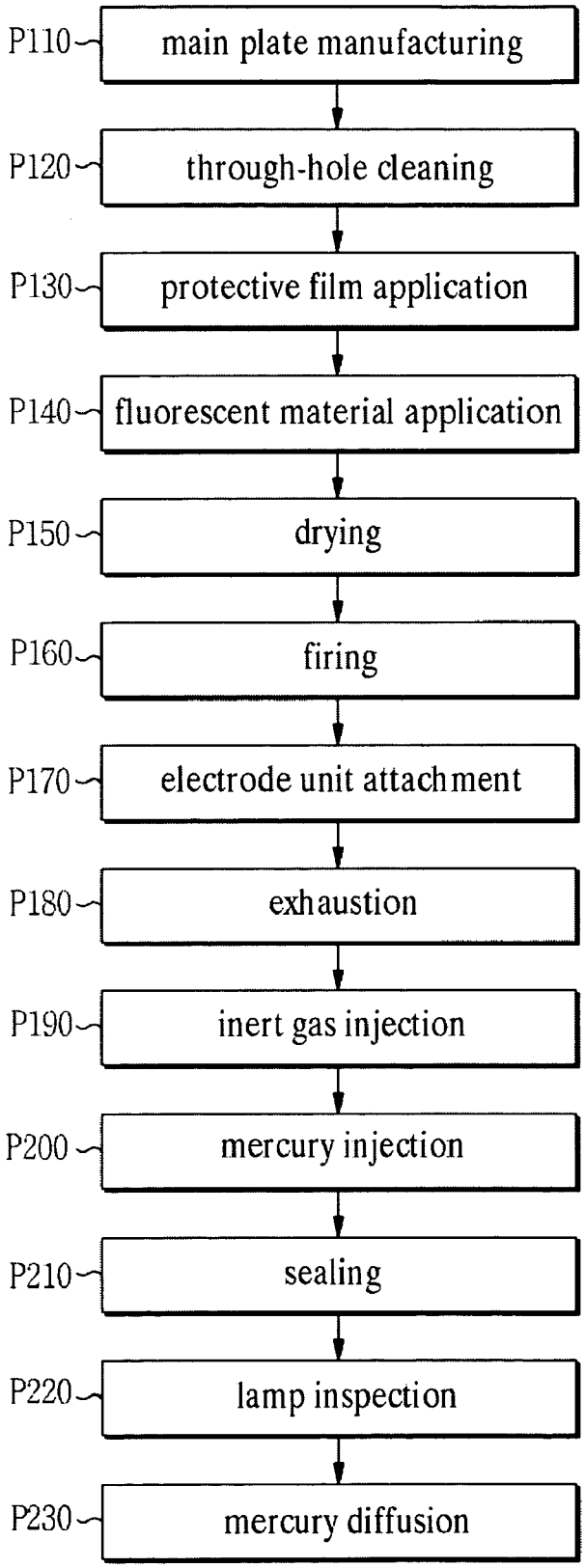
FIG. 7 is a flow chart illustrating processes of a flat fluorescent lamp manufacturing method according to a second preferred embodiment of the present invention.

FIG. 7 is a flow chart illustrating processes of a flat fluorescent lamp manufacturing method according to a second preferred embodiment of the present invention.

First, a main plate manufacturing process (P110) is carried out. The main plate manufacturing process is a process for forming the through-holes 112 in the large, sheet-shaped main plate 110 while the through-holes 112 are arranged in parallel with each other at predetermined intervals. The through-holes 112 are not formed separately from the manufacture of the main plate 110. Specifically, the through-holes 112 are formed simultaneously with the molding of the main plate. Consequently, the main plate and the through-holes are manufactured through a single process.

In this case, however, the upper and lower surfaces of the main plate 110 may be formed in the shape of waves, as shown in FIG. 3.

After the main plate 110 is manufactured as described above, a through-hole cleaning process (P120) is carried out. The through-hole cleaning process is a process for removing foreign matter, which is created when the main plate manufacturing process is carried out, from the interiors of the through-holes 112. Specifically, the inner circumferential surfaces of the through-holes 112 are cleaned by washing such that the protective films and the fluorescent materials are easily attached to the inner circumferential surfaces of the through-holes 112, and therefore, brightness of light emitted from the flat fluorescent lamp is uniform. For this reason, the through-hole cleaning process may be omitted when the inner circumferential surfaces of the through-holes 112 are not contaminated, i.e., the inner circumferential surfaces of the through-holes 112 are clean.

Subsequently, a protective film applying process (P130) is carried out. The protective film applying process is a process for applying a thin protective film to the inner circumferential surface of each through-hole 112 such that the thin protective film is formed on the inner circumferential surface of each through-hole 112. One side of the main plate 110 is dipped in a protective film bath containing protective film material, and then the protective film material is suctioned from the other side of the main plate 110 such that the protective films are uniformly applied to the inner circumferential surfaces of the through-holes 112. The protective film applying process is carried out to improve properties of the flat fluorescent lamp, and therefore, the protective film applying process may be omitted according to circumstance.

Subsequently, a fluorescent material applying process (P140) is carried out. The fluorescent material applying process is a process for thinly applying the fluorescent material 130 to the inner circumferential surface of each through-hole 112, on which the protective film 114 is formed. The fluorescent material applying process is carried out in the same fashion as the protective film applying process.

Subsequently, a fluorescent material drying process (P150) is carried out. The fluorescent material drying process is a process for drying and hardening the fluorescent material applied to the inner circumferential surface of each through-hole 112. The fluorescent material drying process is carried out at room temperature for 24±2 hours. Here, the room temperature is a normal temperature ranging from approximately 15 to 25° C. The fluorescent material drying process is a supplementary process, and therefore, the fluorescent material drying process may be omitted according to circumstance.

Subsequently, a firing process (P160) is carried out. The firing process is a process for heating the main plate 110 to high temperature to remove impure gas existing in the through-holes 112 and to securely fix the fluorescent materials 130 to the inner circumferential surfaces of the through-holes 112, respectively, such that the fluorescent materials 130 function properly. The firing process is carried out at a temperature of 700±100° C.

Subsequently, an electrode unit attaching process (P170) is carried out. The electrode unit attaching process is a process for attaching the electrode units 120 to both ends of each of the through-holes 112, on the inner circumferential surfaces of which the fluorescent materials have been applied and which have been fired, respectively, to hermetically seal the through-holes 112. At this time, the electrode unit may have the above-described internal-type electrodes or the above-described external-type electrode.

Subsequently, an exhausting process (P180) is carried out. The discharging process is a process for suctioning gas present in the hermetically sealed space defined by the through-holes 112 and the electrode units 120 to exhaust the gas from the hermetically sealed space. When gas, such as oxygen, is present in the hermetically sealed space, heat is generated when electricity is discharged, and therefore, the service life of the flat fluorescent lamp is reduced. For this reason, it is preferable to completely remove gas from the hermetically sealed space. The exhausting process is carried out such that the pressure in the through-holes 112 is lower than $10^{-2}$ Torr.

The electrode unit attaching process (P170) and the exhausting process (P180) may be simultaneously carried out according to circumstance. Specifically, the electrode units 120 are attached to both ends of each of the through-holes 112, respectively, while gas is removed from the interiors of the through-holes 112 by suction. When the attachment of the electrode units 120 to both ends of each of the through-holes 112 is completed, the interiors of the through-holes 112 are evacuated.

Subsequently, a light-emitting gas injecting process is carried out. The light-emitting gas injecting process comprises an inert gas injecting process (P190) and a mercury (Hg) injecting process (P200).

The inert gas injecting process (P190) is a process for injecting inert gas, such as argon, neon or xenon, into the interiors of the through-holes 112, which are evacuated by the exhausting process. The inert gas serves to expedite electric discharge in the through-holes 112. The inert gas is injected such that the pressure in the through-holes 112 is 10 to 200 Torr.

Subsequently, the mercury injecting process (P200) is carried out. The mercury injecting process is a process for injecting mercury gas into the interiors of the through-holes 112. The mercury gas may be injected into the interiors of the through-holes 112 in several fashions.

Figure 8:
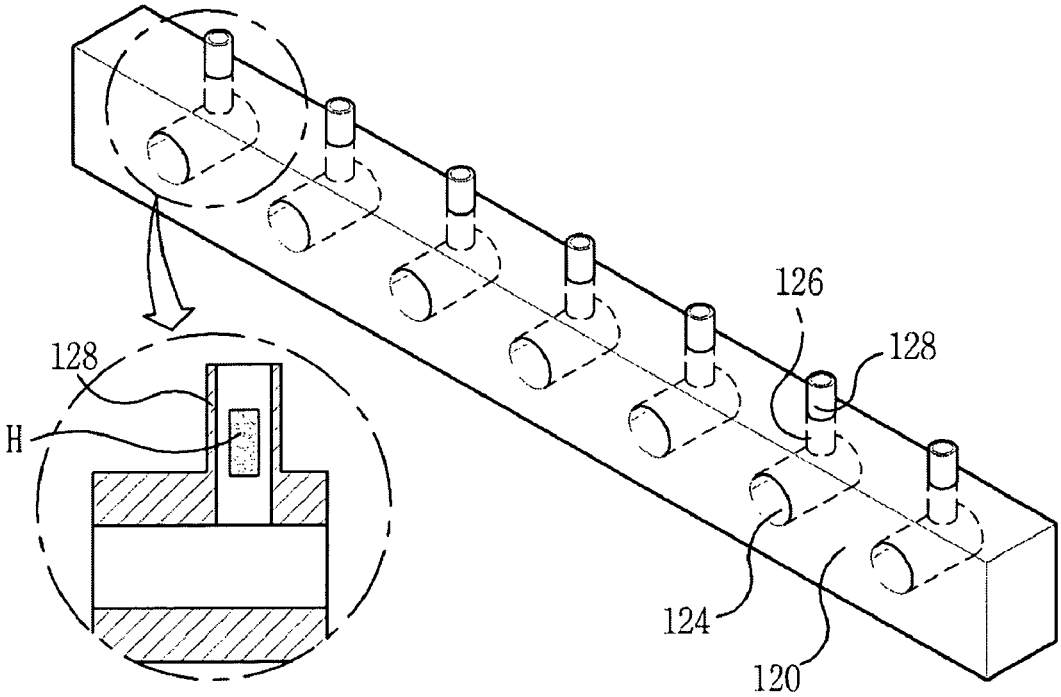
FIG. 8 is an illustrative view showing a mercury-injection process of the flat fluorescent lamp manufacturing method according to the second preferred embodiment of the present invention.

The mercury gas may be injected into the interiors of the through-holes 112 using mercury getters H. The mercury getters H are provided adjacent to the through-holes 112, and then high frequency is applied to the mercury getters from the outside to diffuse mercury gas in the interiors of the through-holes 112. After the mercury gas is diffused in the interiors of the through-holes 112, the mercury getters are removed. In the case that the mercury is injected using the mercury getters H, the electrode unit 120 is formed in the shape shown in FIG. 8. Specifically, the electrode unit 120 further comprises: injection holes 126 formed at predetermined positions thereof such that the injection holes 126 are connected to the depression parts 124 formed at the electrode unit 120; and injection pipes 128 extending from the respective injection holes 126. The mercury getters H are disposed at predetermined positions in the respective injection pipes 128. After the injection of mercury is completed, the injection holes 126 are sealed, and at the same time, the injection pipes 128 are removed.

The mercury gas may be directly injected into the through-holes 112. Specifically, the injection holes 126 are formed at predetermined positions of the electrode unit 120 such that the injection holes 126 are connected to the through-holes 112, respectively, and then the mercury gas is supplied into the interiors of the through-holes 112 through the injection holes 126. In this case, the electrode unit 120 is formed in the shape shown in FIG. 9. Specifically, the electrode unit 120 further comprises only the injection holes 126. To each injection hole 126 is connected an additional gas injecting device I for injecting the mercury gas. To the gas injecting device I is connected a branch pipe B3, which is connected to a mercury storing unit (not shown) that stores mercury gas. Consequently, the mercury gas is supplied into the interiors of the through-holes 112 through the branch pipe B3. After the injection of mercury gas is completed, the injection holes 126 are sealed.

Figure 9:
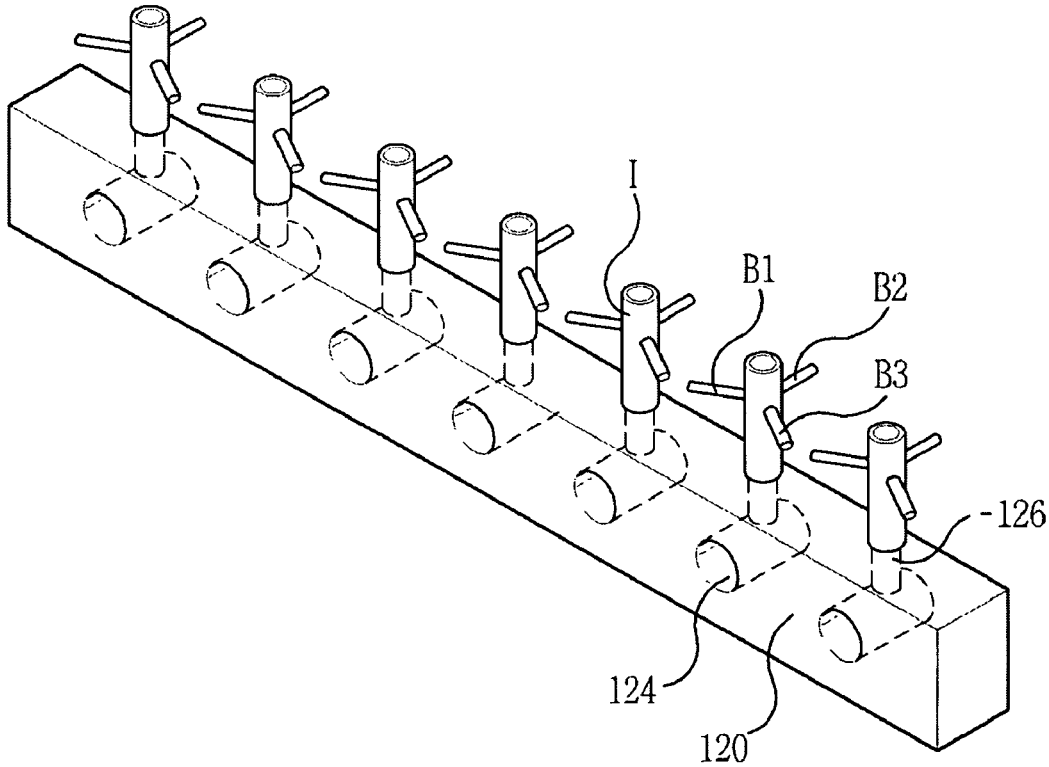
FIG. 9 is an illustrative view showing another example of the mercury-injection process shown in FIG. 8.

In the case that the mercury gas is injected into the interiors of the through-holes 112, the exhausting process (P180), the inert gas injecting process (P190) and the mercury injecting process (P200) may be simultaneously carried out using the additional gas injecting devices I. As shown in FIG. 9, gas injecting devices I, each of which has three branch pipes B1, B2 and B3, are connected to the injection holes 126, respectively. The first branch pipes B1 are connected to a suctioning device (not shown). Consequently, the suctioning device suctions gas existing in the interiors of the through-holes 112 through the first branch pipes B1 to remove the gas from the interiors of the through-holes 112 when the suctioning device is operated.

The inert gas is injected into the interiors of the through-holes 112 under a predetermined pressure though the second branch pipes B2, which are connected to an inert gas storing unit (not shown) that stores inert gas. The mercury gas is injected into the interiors of the through-holes 112 through the third branch pipes B3, which are connected to the mercury storing unit (not shown) that stores mercury gas. In this way, the above-mentioned three processes are successively carried out.

Liquid mercury may be injected into the through-holes 112. In this case, the liquid mercury is injected into the interiors of the through-holes 112 through the injection holes, the injection holes are sealed, and the interiors of the through-holes 112 are heated to evaporate and diffuse the mercury.

After the mercury is injected into the interiors of the through-holes 112, a first mercury diffusing process for primarily heating the main plate to diffuse the mercury is preferably carried out to uniformly diffuse the injected mercury in the interiors of the through-holes 112. The first mercury diffusing process is a process for uniformly diffusing the injected mercury in the interiors of the through-holes 112. The first mercury diffusing process is carried out at a temperature of 400±30° C.

Subsequently, a sealing process (P210) is carried out. The sealing process is a process for hermetically sealing the inner space defined by the through-holes 112 and the electrode units 120 such that the inner space is isolated from the outside. Specifically, the sealing process is a process for sealing the injection holes 126 formed to inject the inert gas and the mercury into the interiors of the through-holes 112.

When the mercury is injected into the interiors of the through-holes 112 using the mercury getters H, the injection holes 126 are sealed, and at the same time, the injection pipes 128 are removed by cutting. When the mercury gas is injected into the interiors of the through-holes 112, on the other hand, only the injection hole sealing operation is performed.

Subsequently, a lamp inspecting process (P220) is carried out. The lamp inspecting process is a process for inspecting the manufactured flat fluorescent lamp 100 to determine whether the manufactured flat fluorescent lamp 100 is normally operated or not. In the lamp inspecting process, the manufactured flat fluorescent lamp 100 is inspected to determine whether the flat fluorescent lamp emits light or not after electric current is supplied to the flat fluorescent lamp. The lamp inspecting process is a supplementary process, and therefore, the lamp inspecting process may be omitted according to circumstance.

If the flat fluorescent lamp normally emits light, a second mercury diffusing process (P230) is preferably carried out. The second mercury diffusing process is a process for secondarily diffusing the mercury. The uniform diffusion of the mercury in the interiors of the through-holes 112 is important in efficiency and light emission of the flat fluorescent lamp. For this reason, the second mercury diffusing process is carried out. The second mercury diffusing process is carried out by reheating the main plate 110 to a temperature of 250 to 450° C. The mercury is more uniformly diffused through the second mercury diffusing process, and therefore, light having more improved brightness is obtainable. The second mercury diffusing process is a supplementary process, and therefore, the second mercury diffusing process may be omitted according to circumstance.

A rubbing process for forming an optical light guide panel pattern on the upper surface of the main plate 110 may be further carried out. The rubbing process may be carried out simultaneously when the main plate manufacturing process (P110) is carried out. Alternatively, the rubbing process may be carried out after the manufacture of the flat fluorescent lamp is completed.

A reflective panel forming process for forming the reflective panel 150 that reflects visible light on the lower surface of the main plate 110 may be further carried out. The reflective panel forming process may be carried out either by depositing a reflective material that can reflect the visible light on the lower surface of the main plate 110 or by attaching an additional reflective panel to the lower surface of the main plate 110.

All the processes of the flat fluorescent lamp manufacturing method except for the main plate manufacturing process (P110) may be successively carried out. For example, the main plate may be moved on a conveyor belt such that the processes of the flat fluorescent lamp manufacturing method can be successively carried out.

Embodiment 3

Flat Fluorescent Lamp Board Manufacturing Apparatus 1

Figure 10:
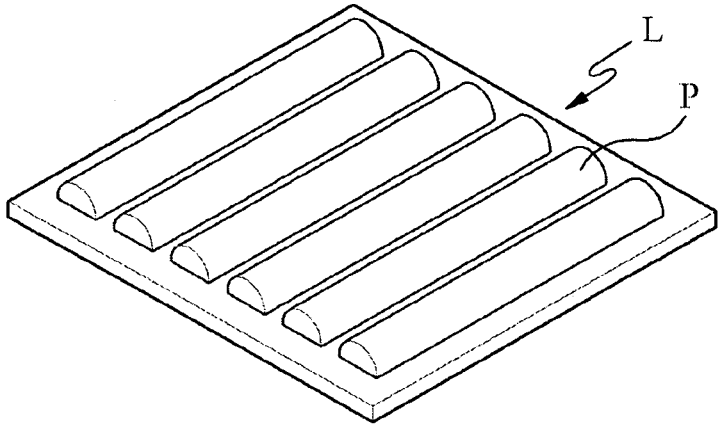
FIG. 10 is a perspective view showing the structure of a flat fluorescent lamp board.

A flat fluorescent lamp board L, which is manufactured by a flat fluorescent lamp board manufacturing apparatus 200 according to a third preferred embodiment of the present invention, is a glass board having a plurality of semicircular protrusions P formed thereon such that the semicircular protrusions P are arranged in parallel with one another, as shown in FIG. 10. At the protrusions P are formed electrodes, respectively, such that the protrusions P independently emit light. The flat fluorescent lamp board is used for a flat fluorescent lamp having a structure different from that of the flat fluorescent lamp according to the previously described embodiment of the present invention. The flat fluorescent lamp board manufacturing apparatus 200 will be described hereinafter in detail.

Figure 11:
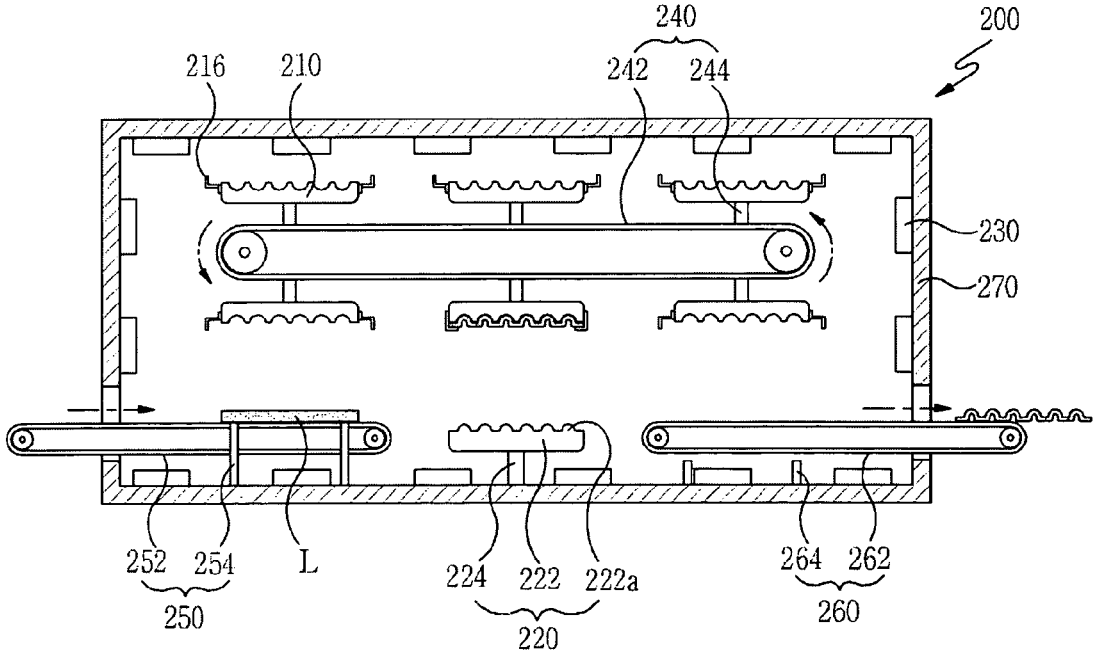
FIG. 11 is a sectional view showing the structure of a flat fluorescent lamp board manufacturing apparatus according to a third preferred embodiment of the present invention.

Referring to FIG. 11, the flat fluorescent lamp board manufacturing apparatus 200 comprises a plurality of first board molding units 210, a second board molding unit 220, and a plurality of heating units 230.

Figure 14:
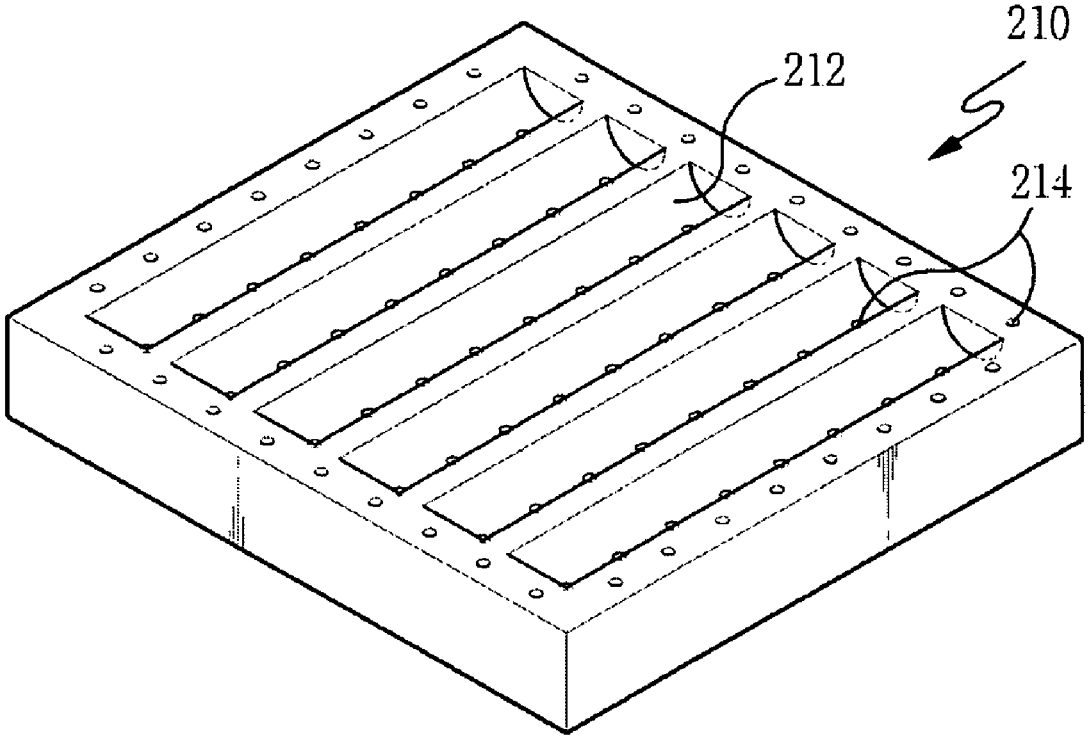
FIG. 14 is a perspective view showing the structure of an example of the molding unit according to the present invention.

Each of the first board molding units 210 takes a shape corresponding to the flat fluorescent lamp board L shown in FIG. 10. Specifically, each of the first board molding units 210 has a plurality of grooves 212 whose sectional shapes are semicircular formed thereon, as shown in FIG. 14. The grooves 212 are arranged in parallel with one another at predetermined intervals. Each of the first board molding units 210 is used as a mold for forming the shape of the flat fluorescent lamp board when the flat fluorescent lamp board is molded.

At each of the first board molding units 210 is preferably provided a board fixing part for fixing the glass board L supplied from the outside. Specifically, the board fixing part serves to fix the glass board L supplied to the corresponding first board molding unit 210 from the outside such that the flat fluorescent lamp board is molded at a predetermined position of the molding unit 210.

The board fixing part may comprise a plurality of vacuum suction holes 214. As shown in FIG. 14, the vacuum suction holes 214 are formed at the grooves 212 such that the vacuum suction holes 214 are arranged along the middle of each groove 212 while being spaced apart from one another by a predetermined distance. The vacuum suction holes 214 serve not only to fix the glass board L to the molding unit when the glass board L is loaded to the corresponding first board molding unit 210 but also to suction the glass board when the glass board is molded. That is, the vacuum suction holes 214 serve as the board molding unit. Preferably, the vacuum suction holes 214 are formed at the edge of each first board molding unit 210 as well as at the middles of the grooves 212 of each first board molding unit 210 such that the glass board is more stably fixed. The vacuum suction holes 214 are used not only to fix the glass board to the corresponding first board molding unit 210 when the board is loaded but also to separate the board from the corresponding first board molding unit 210. For this reason, the vacuum suction holes 214 are connected not only to a vacuum pump (not shown) but also to a gas supply pump (not shown). When the glass board is to be separated from the corresponding first board molding unit 210 after the glass board is molded, gas is supplied to the corresponding first board molding unit 210 through the vacuum suction holes 214. As a result, the glass board is separated from the corresponding first board molding unit 210 by the pressure of the gas supplied to the corresponding first board molding unit 21. In this way, the glass board is easily and quickly separated from the corresponding first board molding unit 210.

The board fixing part may comprise board fixing members 216 provided at both sides of each first board molding unit 210 for mechanically fixing the glass board L to each first board molding unit 210. Specifically, the board fixing members 216, each of which has a groove into which the glass board L is inserted, are provided at both sides of each first board molding unit 210 such that the board fixing members 216 can be horizontally moved. When the glass board L approaches the corresponding first board molding unit 210, the board fixing members 216 is positioned far from the corresponding first board molding unit 210. When the glass board L comes into contact with the corresponding first board molding unit 210, the board fixing members 216 is moved toward the corresponding first board molding unit 210 such that both sides of the glass board L is held by the board fixing members 216, respectively. In this way, the glass board is securely fixed to the corresponding first board molding unit 210.

The board fixing part may comprise the vacuum suction holes 214 and the board fixing members 216. In this case, the glass board is more stably and securely fixed to corresponding first board molding unit 210, and it is possible to decrease vacuum level in the vacuum suction holes 214.

Furthermore, the board fixing part may comprise an electrostatic chuck (not shown). Specifically, the electrostatic chuck is mounted in each first board molding unit 210 for generating an electrostatic force in each first board molding unit 210. When the glass board is to be fixed to the corresponding first board molding unit 210, electric current is supplied to the electrostatic chuck mounted in the corresponding first board molding unit 210 such that the glass board is fixed to the corresponding first board molding unit 210 by the electrostatic chuck. In this case, however, the board fixing members 216 are also provided at both sides of each first board molding unit 210 such that the glass board is more effectively fixed to the corresponding first board molding unit 210.

The second board molding unit 220 is a component that molds the board loaded to the corresponding first board molding unit 210 in the shape of the flat fluorescent lamp board. The shape of the flat fluorescent lamp board is as shown in FIG. 10. Specifically, the semicircular protrusions P are formed on the flat fluorescent lamp board such that semicircular protrusions P are arranged in parallel with one another.

The second board molding unit may be provided in three forms.

In the first form, the flat fluorescent lamp board is molded only using each first board molding unit without the provision of the second board molding unit. The glass board, which has been heated to a temperature of 600±300° C., and therefore, lost its hardness, is suctioned from the rear surface of the glass board by a strong suction force to mold the flat fluorescent lamp board. To this end, each first board molding unit 210 comprises a plurality of vacuum suction holes 214 and a suctioning member (not shown). The vacuum suction holes 214 are holes formed at predetermined positions of the grooves of each first board molding unit 210, and the suctioning member is a vacuum pump, which is connected to the vacuum suction holes 214 for suctioning gas. Specifically, the glass board L is suctioned from the rear surface of the glass board L by the vacuum pump having a strong suction force such that the glass board L is formed in the same shape as the grooves 212 formed at the corresponding first board molding unit 210. In this case, the board loading operation and the board molding operation can be performed only using the vacuum suction holes formed at each first board molding unit 210. Consequently, the structure of the flat fluorescent lamp board manufacturing apparatus is simplified.

In the second form, the second board molding unit 220 comprises a molding member 222 and a driving member 224. In this case, the front surface of the glass board, which has been heated to a temperature of 600±300° C., is mechanically pressed such that the glass board is formed in the same shape as the grooves 212 formed at the corresponding first board molding unit 210. The molding member 222 of the second board molding unit 220 takes a shape corresponding to that of each first board molding unit 210, and the molding member 222 of the second board molding unit 220 is opposite to one of the first board molding units 210. The driving member 224 serves to drive the molding member 222 such that the molding member 222 can be moved upward to the corresponding first board molding unit 210 and downward from the corresponding first board molding unit 210. The molding member 222 approaches the glass board L until the molding member 222 comes into contact with the glass board L. After the molding member 222 comes into contact with the glass board L, the molding member 222 is further moved upward such that protrusions 222*a* of the molding member 222 are engaged with the grooves 212 of the corresponding first board molding unit 210, respectively, to mold the glass board. With the above-mentioned type second board molding unit 220, the glass board is molded only using the molding member having the above-described structure without the provision of the vacuum pump.

As described above, the glass board is molded through a single process. However, the board molding process may be carried out step by step. Specifically, the upward movement of the molding member 222 is carried out step by step after the molding member 222 comes into contact with the glass board. The molding member 222 is moved upward to the corresponding first board molding unit 210 by a predetermined depth, and then is stopped for a predetermined period of time. Thereafter, the molding member 222 is further moved upward to the corresponding first board molding unit 210 by the predetermined depth, and then is stopped for the predetermined period of time. The upward movement and stoppage of the molding member 222 are repeated to accomplish step-by-step molding of the glass board. In this case, it is necessary that the molding member 222 be horizontally moved along with the glass board, while the molding member 222 is in contact with the glass board, to press the glass board. To this end, the molding member 222 is constructed such that the molding member 222 is circulated like the first board molding units 210. When the glass board is molded step by step as described above, damage to the glass board due to abrupt deformation of the glass board during molding and nonuniformity of the glass board are effectively prevented.

In the third form, the glass board may be molded by the combination of the second board molding unit 220 and the corresponding first board molding unit 210. Specifically, the glass board is suctioned from the rear surface of the glass board, and at the same time, the glass board is mechanically pressed from the front surface of the glass board, so as to the mold the glass board. To this end, the combined board molding unit preferably comprises a plurality of vacuum suction holes, a suction member, a molding member, and a driving member. The vacuum suction holes, the suction member, the molding member, and the driving member of the combined board molding unit are identical in construction and operation to those of the first and second board molding units as described above. With the combined board molding unit, the flat fluorescent lamp board can be molded in a more accurate shape.

The heating units 230 serve to heat the first board molding units 210 and the glass board L. Specifically, the heating units 230 heat the glass board such that the glass board can be easily molded in a desired shape. The glass board is heated to a temperature near the melting point of glass such that the glass board is flexible to be molded in the shape of a flat fluorescent lamp board.

Preferably, the heating units 230 are provided, in large numbers, at several positions of the flat fluorescent lamp board apparatus, as shown in FIG. 11. As a result, the temperature in the flat fluorescent lamp board apparatus is maintained at a predetermined temperature such that the first board molding units are preheated to the predetermined temperature. Alternatively, the heating units 230 may be mounted in all the walls of the flat fluorescent lamp board apparatus such that heat is generated from all the walls of the flat fluorescent lamp board apparatus.

Also, the heating units 230 may comprise main heating units and preheating units. The glass, which is a board material used in the third preferred embodiment of the present invention, loses its hardness when it is heated to a temperature of 600±300° C., and therefore, the glass board can be easily molded. Consequently, it is necessary that the glass board be heated to a very high temperature in the board molding process. However, it is not necessary that the glass board be heated to such a very high temperature in other processes. When the glass board is heated to such a very high temperature in other processes, the glass board is easily deformed, and as a result, it is difficult to deal with the glass board. Therefore, the heating units comprise the main heating units and the preheating units. The main heating units serve to heat the glass board to a high temperature necessary to mold the glass board, and the preheating units serve to preheat the glass board or the first board molding units such that the glass board or the first board molding units are maintained at a temperature lower than the temperature necessary to mold the glass board.

Consequently, it is preferable to provide the main heating units, which heat the glass board to a high temperature of 600±300° C., at the position where the glass board is molded, and the preheating units, which heat the first board molding units to a temperature of room temperature to 200° C., at other positions where the glass board is not molded.

Preferably, the flat fluorescent lamp board manufacturing apparatus 200 further comprises a conveying unit 240 for conveying each first board molding unit 210 from a position where the board is loaded to another position where the board is discharged. By the provision of the conveying unit 240, each first board molding unit 210 is automatically conveyed from the board loading position, which is a starting position of the flat fluorescent lamp manufacturing process, to the board discharging position, which is an ending position of the flat fluorescent lamp manufacturing process. Consequently, automation of the flat fluorescent lamp manufacturing process is accomplished. When the glass board L is loaded to one of the first board molding units 210 at the board loading position, the corresponding first board molding unit 210 is conveyed by a conveying unit 240 such that various processes are carried out. When the finished flat fluorescent lamp board reaches the board loading position, the finished flat fluorescent lamp board is discharged from the flat fluorescent lamp manufacturing apparatus.

Preferably, the conveying unit 240 comprises a conveying route 242 and a plurality of conveying members 244. The conveying route 242 is formed in the shape of a conveying rail connected between the board loading position and the board discharging position. The conveying members 244 are connected to the conveying rail such that the conveying members 244 can be moved along the conveying rail. Also, the conveying members 244 are fixedly attached to the first board molding units 210.

Preferably, the conveying unit 240 further comprises a power-supplying member (not shown) for supplying power necessary to move the conveying members 244, although the conveying members 244 may be directly moved by an operator. Via the power supplied from the power-supplying member, however, the conveying members 244 can be moved at an accurate speed, and therefore, efficiency of the flat fluorescent lamp board manufacturing apparatus according to the third preferred embodiment of the present invention is improved.

The conveying route 242 may be constructed in various forms.

First, the conveying route 242 is constructed in a linear circulation system, in which the respective first board molding units 210 leave the board loading position and then reach the board loading position in a linear circulation fashion. In the linear circulation type conveying route 242, the respective first board molding units 210 are moved horizontally in a predetermined direction and are then moved downward to perform the processes, and thereafter, the respective first board molding units 210 are moved upward and are then moved horizontally in the predetermined direction to return to the board loading position, as shown in FIG. 11. The linear circulation type conveying route may be disposed at the lower part of the flat fluorescent lamp board manufacturing apparatus. In this case, the glass board L is fixed to each first board molding unit 310 due to its own weight, and therefore, the loading operation of the glass board L on the corresponding first board molding unit 310 is more easily carried out as compared to the loading operation of the glass board L on the corresponding first board molding unit 210 in the linear circulation type conveying route disposed at the upper part of the flat fluorescent lamp board manufacturing apparatus.

Figure 13:
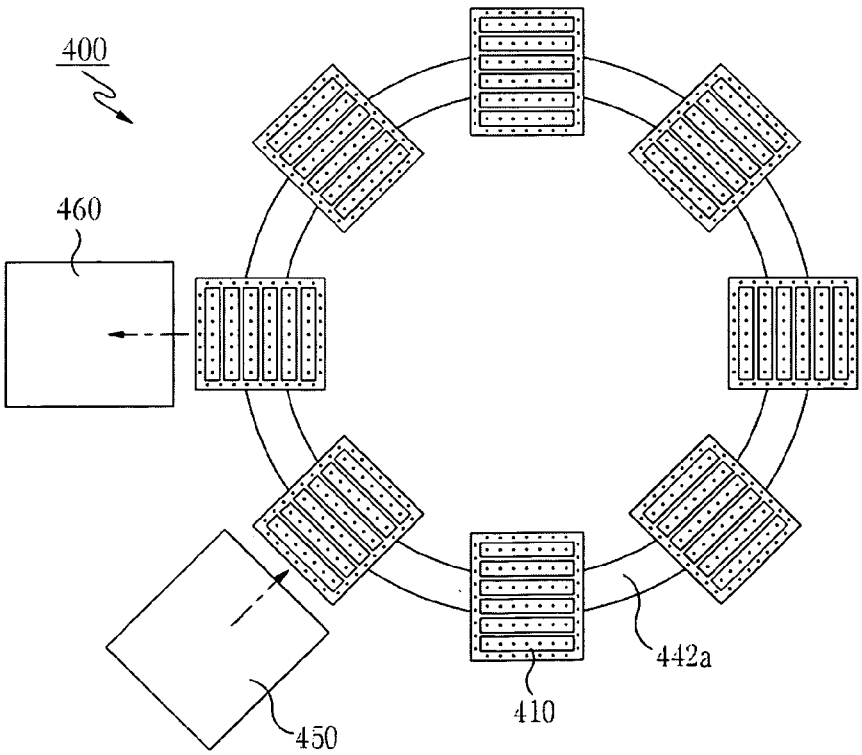
FIG. 13 is a plan view showing the structure of another example of the conveying route according to the present invention.

Alternatively, the conveying route may be a circular or elliptical circulation type conveying route 442*a*, which is shown in FIG. 13. As shown in FIG. 13, the respective first board molding units 210 leave the board loading position and then reach the board loading position in a circular circulation fashion. In the circular circulation type conveying route 442*a*, the board loading position and the board discharging position are provided adjacent to each other. Alternatively, the board loading operation and the board discharging operation may be carried out at the same position. Consequently, the circular circulation type conveying route 442*a* has an advantage in that the loading and discharging of the board are effectively accomplished. Furthermore, the board loading operation and the board discharging operation may be carried out by means of a single component.

The flat fluorescent lamp board manufacturing apparatus 200 further comprises a loading unit 250. The loading unit 250 is disposed at the board loading position for supplying the glass board to be processed to the corresponding first board molding unit 210. The glass board may be manually loaded to the corresponding first board molding unit 210 by an operator. It is preferable, however, that the glass board be automatically loaded to the corresponding first board molding unit 210 by the loading unit 250, by which efficiency of the board loading operation is improved.

Figure 12:
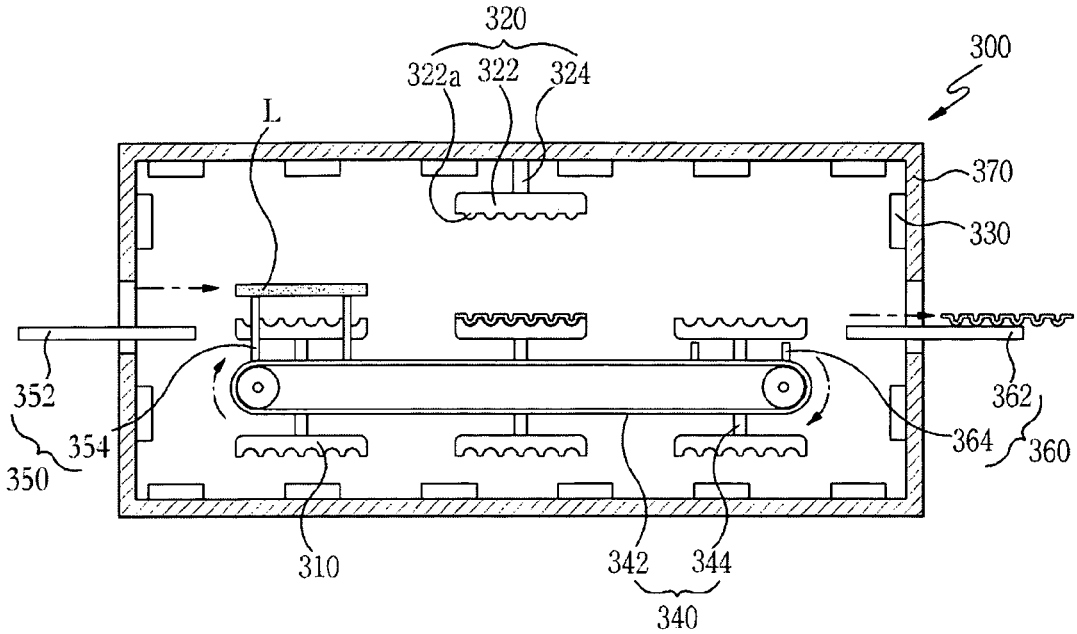
FIG. 12 is a sectional view showing the structure of a flat fluorescent lamp board manufacturing apparatus according to a fourth preferred embodiment of the present invention.

The loading unit may be constructed in two forms. In the first form, the loading unit comprises a loading member 252 and a lifting member 254. The loading member 252 has a loading surface for allowing the glass board to be loaded thereon. The loading member 252 serves to convey the glass board loaded on the loading surface thereof to the board loading position. The loading member 252 may be constructed as a conveyor system, as shown in FIG. 11. The lifting member 254 serves to lift the glass board L conveyed to the board loading position by the loading member 252 such that the glass board is fixed to the corresponding first board molding unit 210. The lifting member 254 comprises a plurality of lifting pins, as shown in FIG. 11. The lifting pins are moved vertically to lift the glass board. In the case that a conveying unit 340 is disposed at the lower part of the flat fluorescent lamp board manufacturing apparatus, as shown in FIG. 12, a lifting member 354 serves to lift the glass board L conveyed to the board loading position by a loading member 352 and to place the glass board on the corresponding first board molding unit 310.

Alternatively, the loading unit may be constructed as a robotic system. Specifically, the loading unit may comprise a robot arm (not shown) for loading the glass board and a driving member (not shown) for driving the robot arm horizontally and vertically.

The flat fluorescent lamp board manufacturing apparatus 200 further comprises a discharging unit 260. The discharging unit 260 is identical in construction and operation to the loading unit 250, and therefore, a detailed description of the discharging unit 260 will not be given.

It is necessary to maintain the interior of the flat fluorescent lamp board manufacturing apparatus 200 at a predetermined temperature. To this end, the flat fluorescent lamp board manufacturing apparatus 200 further comprises a chamber 270 for isolating the interior of the flat fluorescent lamp board manufacturing apparatus 200 from the outside. The components of the flat fluorescent lamp board manufacturing apparatus 200 are disposed in the chamber 270. However, the loading unit 250 and the discharging unit 260 may be disposed partially within the chamber 270 such that the loading unit 250 and the discharging unit 260 are disposed partially inside the chamber 270 and partially outside the chamber 270.

Embodiment 4

Flat Fluorescent Lamp Board Manufacturing Apparatus 2

FIG. 12 is a sectional view showing a flat fluorescent lamp board manufacturing apparatus 300 according to a fourth preferred embodiment of the present invention. The flat fluorescent lamp board manufacturing apparatus 300 is identical in construction and operation to the flat fluorescent lamp board manufacturing apparatus 200 except that the conveying unit 340 is disposed at the lower part of the flat fluorescent lamp board manufacturing apparatus 300. As the conveying unit 340 is disposed at the lower part of the flat fluorescent lamp board manufacturing apparatus 300, and therefore, the first board molding units 310 are disposed at the lower part of the flat fluorescent lamp board manufacturing apparatus 300, the glass board L can be easily loaded on the corresponding first board molding unit 310. Furthermore, the glass board comes into tight contact with the corresponding first board molding unit 310 due to its own weight, and therefore, the board molding operation is easily performed.

Embodiment 5

Flat Fluorescent Lamp Board Manufacturing Method

Figure 15:
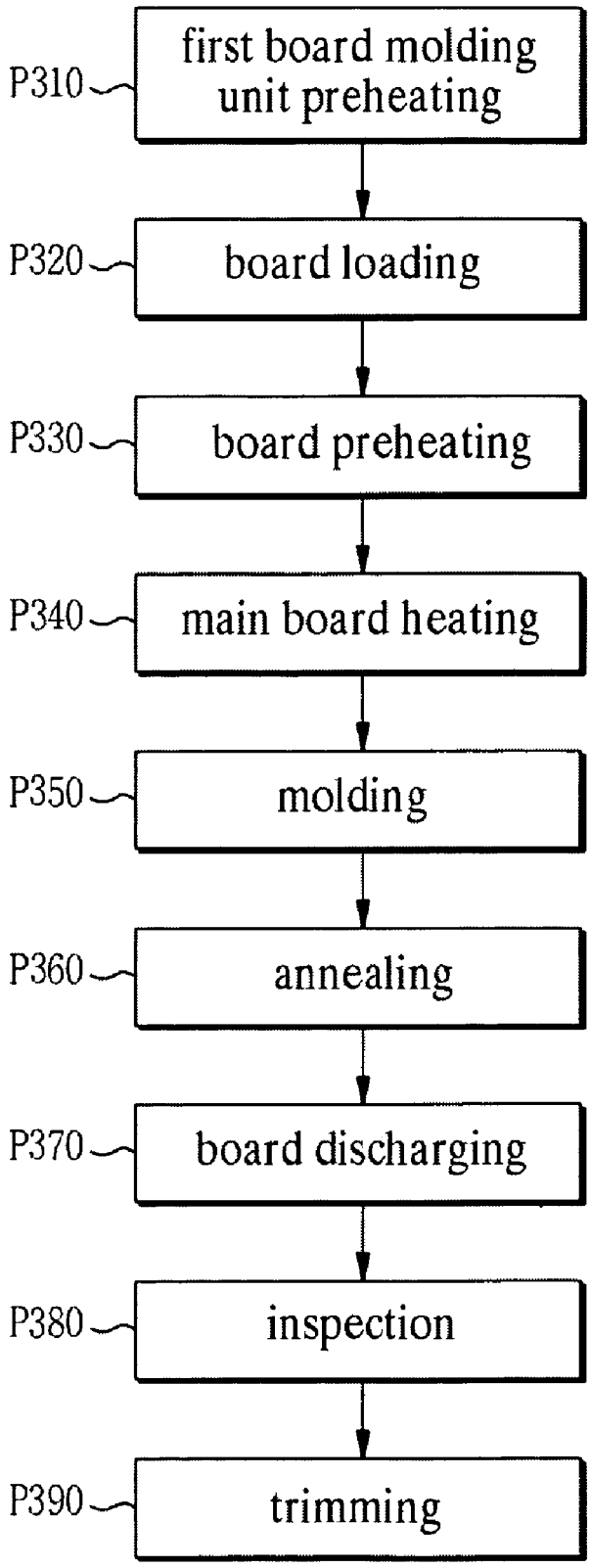
FIG. 15 is a flow chart illustrating processes of a flat fluorescent lamp board manufacturing method according to a fifth preferred embodiment of the present invention.

Now, a flat fluorescent lamp board manufacturing method according to a fifth preferred embodiment of the present invention, which is applied to the flat fluorescent lamp board manufacturing apparatus 300, will be described in detail with reference to FIG. 15. FIG. 15 is a flow chart illustrating processes of the flat fluorescent lamp board manufacturing method.

The first board molding units 210 are driven while the first board molding units 210 are preheated. Consequently, a first board molding unit preheating process (P310) for preheating the first board molding units 210 to a predetermined temperature is carried out first to manufacture the flat fluorescent lamp board. In the first board molding unit preheating process, the first board molding units 210 are preheated to a temperature of room temperature to 200° C. The preheating process of the first board molding units 210 is carried out at a predetermined position of the flat fluorescent lamp board manufacturing apparatus, although the interiors of the flat fluorescent lamp board manufacturing apparatus may be preheated to the above-mentioned preheating temperature such that the first board molding units 210 are maintained at the preheated temperature. The first board molding units 210 are preheated as described above so as to considerably reduce time necessary to mold the board. When the first board molding units 210 are preheated, the glass board L can be easily molded.

Subsequently, a board loading process (P320) for loading the glass board L to the corresponding first board molding unit 210 is carried out. The board loading process is a process for supplying the glass board L to the corresponding first board molding unit 210 placed at the board loading position. The board loading process may comprise steps of: conveying the glass board to the board loading position from the outside and moving the glass board upward or downward such that the glass board approaches the corresponding first board molding unit 210; and fixing the approached glass board to the corresponding first board molding unit 210.

The glass board may be fixed to the corresponding first board molding unit 210 in various fashions. For example, the glass board may be fixed to the front surface of the corresponding first board molding unit 210 by vacuum suction, the glass board may be fixed to the front surface of the corresponding first board molding unit 210 by an electrostatic force, or the glass board may be mechanically fixed to the front surface of the corresponding first board molding unit 210 by an additional board fixing member. Otherwise, the glass board may be fixed to the front surface of the corresponding first board molding unit 210 via a combination of at least two of the board fixing fashions described above. When the glass board is fixed to the corresponding first board molding unit 210 via the combined board fixing fashion, the glass board is securely fixed to the corresponding first board molding unit 210, and therefore, the glass board is effectively prevented from being separated from the corresponding first board molding unit 210 during the processes.

Subsequently, a board preheating process (P330) for preheating the glass board loaded to the corresponding first board molding unit 210 to a preheating temperature is carried out. The temperature of the glass board loaded to the corresponding first board molding unit 210 from the outside is low, and therefore, the glass board is preheated to the preheating temperature in the board preheating process. However, the interior temperature of the flat fluorescent lamp board manufacturing apparatus may be maintained at a predetermined temperature without using an additional preheating device such that the glass board is naturally preheated.

Subsequently, a molding process for molding the glass board loaded to the corresponding first board molding unit 210 in the shape of a flat fluorescent lamp board is carried out. Preferably, the molding process comprises a main heating process (P340), a molding process (P350), and an annealing process (P360). First, the main heating process is carried out to heat the glass board, which is preheated to the preheating temperature, to a molding temperature at which the glass boards loses its hardness. In the main heating process, the glass board is heated to a temperature of 600±300° C., such that the glass board becomes malleable, and therefore, the glass board can be easily molded into various shapes. After the glass board is heated such that the glass board can be easily molded, the molding process (P350) is carried out to press the heated glass board such that the glass board is formed in the shape of a flat fluorescent lamp.

The glass board may be molded in several fashions. In the first fashion, the glass board may be suctioned from the rear surface of the glass board by a suction force to mold the glass board. In this case, the vacuum suction holes are formed at the predetermined positions of the grooves of each first board molding unit such that the glass board is strongly suctioned to the corresponding first board molding unit through the vacuum suction holes.

In the second fashion, the front surface of the heated glass board may be pressed by the second board molding unit. In this case, the front surface of the glass board is pressed by the second board molding unit having a shape corresponding to that of each first board molding unit to mold the flat fluorescent lamp board.

In the third fashion, the glass board may be suctioned from the rear surface of the glass board, and at the same time, the front surface of the heated glass board may be pressed by the second board molding unit.

After the molding process is completed, the annealing process (P360) for slowly cooling the molded glass board is carried out. In the annealing process, the temperature of the molded glass board is lowered slowly, and therefore, the glass board is prevented from being deformed or damaged. At this time, the temperature to which the board is cooled is approximately equal to the first board molding unit preheating temperature. In other words, the board is not cooled below the first board molding unit preheating temperature.

After the board is molded as described above, a board discharging process (P370) for discharging the board from the flat fluorescent lamp board manufacturing apparatus is carried out. Preferably, the board discharging process comprises the steps of: separating the board from the corresponding first board molding unit; and discharging the separated board from the flat fluorescent lamp board manufacturing apparatus. In the step of separating the board from the corresponding first board molding unit, gas may be supplied to the board through the vacuum suction holes formed at the corresponding first board molding unit such that the board can be separated from the corresponding first board molding unit. Alternatively, an external force may be applied to the board, in the direction in which the board is moved away from the corresponding first board molding unit, while the edge of the board is held. In this way, the board is separated from the corresponding first board molding unit.

After the board is separated from the corresponding first board molding unit, the board is discharged from the flat fluorescent lamp board manufacturing apparatus by the discharging unit.

Subsequently, a board inspecting process (P380) for inspecting the molded board is carried out. In the board inspecting process, the board is inspected to determine whether the molded board is defective or not.

Finally, a trimming process (P390) is performed to remove unnecessary edge portions from the molded board. In the trimming process, the unnecessary portions formed during molding of the board are removed. Especially when the board is molded using the vacuum suction holes, the protrusions disposed where the vacuum suction holes are formed are removed.

As apparent from the above description, the flat fluorescent lamp according to the present invention comprises a single main plate. Consequently, the flat fluorescent lamp is structurally stable and can be easily manufactured. The flat fluorescent lamp according to the present invention is suitable to large-sized liquid crystal display devices. Also, the flat fluorescent lamp according to the present invention can be easily and conveniently used irrespective of its size. Furthermore, the flat fluorescent lamp according to the present invention is assembled as a single module when the flat fluorescent lamp is mounted in the liquid crystal display devices, and therefore, the assembly of the flat fluorescent lamp according to the present invention is simple and easy.

In the flat fluorescent lamp according to the present invention, several components are combined into a single component, and therefore, the thickness of the flat fluorescent lamp is considerably decreased. Also, expensive parts are not used to manufacture the flat fluorescent lamp according to the present invention, and therefore, the manufacturing costs of the flat fluorescent lamp are considerably reduced.

In the flat fluorescent lamp manufacturing method according to the present invention, the flat fluorescent lamp suitable to large-sized liquid crystal display devices is manufactured by a single process, and therefore, the large-sized flat fluorescent lamp, which can be mounted in the large-sized liquid crystal display devices, is easily manufactured by the simplified process. Especially, various flat fluorescent lamps, which can be used for various-sized liquid crystal display devices, can be easily and conveniently manufactured.

Furthermore, the flat fluorescent lamp manufacturing method according to the present invention can be applied not only to the internal-type electrodes but also to the external-type electrode.

In the flat fluorescent lamp board manufacturing apparatus and method according to the present invention, the flat fluorescent lamp board can be manufactured via assembly line. Consequently, the present invention enables mass-production of the flat fluorescent lamp board and reduces the process time per flat fluorescent lamp board.

What is claimed is:

1. A flat fluorescent lamp for flat panel display backlighting, comprising:

a main plate having at least one through-hole formed to penetrate the main plate, the at least one through-hole being extended from one side surface of the main plate to the other side surface of the main plate;

electrode units attached to respective sides of the main plate, each of the electrode units having at least one electrode corresponding to the at least one through-hole of the main plate, the electrode units sealing respective ends of the at least one through-hole of the main plate;

a fluorescent material applied to an inner circumferential surface of the at least one through-hole of the main plate; and a light-emitting gas filled in an inner space defined by the at least one through-hole of the main plate and the electrode units, wherein each of the electrode units has at least one depression part in which the at least one electrode is disposed, a diameter of the at least one depression part being greater than a diameter of the at least one through-hole of the main plate.

2. The lamp as set forth in claim 1, wherein the main plate is made of glass through which visible light is transmitted.

3. The lamp as set forth in claim 1, wherein the main plate is made of acryl resin through which visible light is transmitted.

4. The lamp as set forth in claim 1, wherein the main plate is provided at an upper surface thereof with the optical light guide panel pattern.

5. The lamp as set forth in claim 1, wherein the main plate is provided at a lower surface thereof with the light reflective material for reflecting visible light.

6. The lamp as set forth in claim 1, wherein the main plate is constructed such that a thickness of a section of the main plate where the at least one through-hole is formed is less than that of a section of the main plate where the at least one through-hole is not formed.

7. The lamp as set forth in claim 1, wherein the at least one electrode of each of the electrode units is an internal-type electrode, which is at least partially disposed inside the at least one through-hole.

8. The lamp as set forth in claim 1, wherein the at least one electrode of each of the electrode units is an external-type electrode, which is disposed outside the at least one through-hole.

9. The lamp as set forth in claim 8, wherein a surface of the at least one electrode is formed in a shape of a wave, and a shape of a surface of each of the electrode units to which the at least one electrode is attached corresponds to that of the surface of the at least one electrode.

10. The lamp as set forth in claim 1, wherein the fluorescent material is selected from the group consisting of phosphate-based fluorescent material, silicate-based fluorescent material, tungstate-based fluorescent material, and sulfide-based fluorescent material.

11. The lamp as set forth in claim 1, wherein the light-emitting gas is selected from the group consisting of argon (Ar), neon (Ne), xenon (Xe), and mercury (Hg), or a combination thereof.

12. The lamp as set forth in claim 1, further comprising:

a protective film disposed between the inner circumferential surface of the at least one through-hole and the fluorescent material.

13. The lamp as set forth in claim 1, wherein the flat fluorescent lamp comprises the optical light guide pattern integrally formed on the first surface of the main plate and the light reflective material integrally formed on the second surface of the main plate.

14. The lamp as set forth in claim 1, further comprising:

a diffusion panel disposed on an upper surface of the main plate.

15. The lamp as set forth in claim 1, further comprising:

a prism sheet disposed on an upper surface of the main plate.

* * * * *